US008875627B2

(12) United States Patent
Bartesaghi

(10) Patent No.: US 8,875,627 B2
(45) Date of Patent: Nov. 4, 2014

(54) MACHINE FOR THE IN-LINE TRANSFORMATION OF SINGLE-USE PRODUCTS, HEAT-PRINTED WITH COLOURED WAXES AND PARAFFINS

(75) Inventor: Angelo Bartesaghi, Lecco (IT)

(73) Assignee: O-Pac S.R.L. Societa a Socio Unico, Valmadrera (Lecco) (IT)

( * ) Notice: Subject to any disclaimer, the term of this patent is extended or adjusted under 35 U.S.C. 154(b) by 648 days.

(21) Appl. No.: 12/736,332

(22) PCT Filed: Mar. 26, 2009

(86) PCT No.: PCT/IB2009/005128

§ 371 (c)(1),
(2), (4) Date: Dec. 15, 2010

(87) PCT Pub. No.: WO2009/125266

PCT Pub. Date: Oct. 15, 2009

(65) Prior Publication Data

US 2011/0079156 A1 Apr. 7, 2011

(30) Foreign Application Priority Data

Apr. 11, 2008 (IT) ..... MI2008A0651

(51) Int. Cl.

| | |
|---|---|
| ***B41L 13/00*** | (2006.01) |
| ***B41F 5/24*** | (2006.01) |
| ***B41F 31/00*** | (2006.01) |
| ***B41F 13/54*** | (2006.01) |
| ***B41F 15/08*** | (2006.01) |

(52) U.S. Cl.

CPC ..... *B41F 5/24* (2013.01); *B41F 31/002* (2013.01); *B41F 13/54* (2013.01); *B41F 15/0836* (2013.01)

USPC ..... 101/120; 101/127; 101/212

(58) Field of Classification Search

USPC ..... 101/120, 212, 119, 127

See application file for complete search history.

(56) References Cited

U.S. PATENT DOCUMENTS

| | | | |
|---|---|---|---|
| 2,268,594 | A | 1/1942 | Huber |
| 2,382,920 | A | 8/1945 | Schaefer |

(Continued)

FOREIGN PATENT DOCUMENTS

| | | | |
|---|---|---|---|
| GB | 815 433 | A | 6/1959 |
| GB | 2 106 836 | A | 4/1983 |

(Continued)

OTHER PUBLICATIONS

PCT Search Report dated Nov. 3, 2009.

*Primary Examiner* — David Banh

(74) *Attorney, Agent, or Firm* — Hedman & Costigan, P.C.; James V. Costigan; Kathleen A. Costigan

(57) ABSTRACT

The invention describes a machine (10) for the in-line transformation of single-use products, comprising at least one unwinding group (12) for one or more reels (14) of web-shaped material (100), which constitutes the base support for said product, at least one printing group (18), arranged downstream of said unwinding group (12), capable of heat-printing decorative patterns, trademarks and/or inscriptions with a paraffin or natural wax-based ink (W) and/or mixtures thereof on the web-shaped material (100), and at least one folding and cutting group (20), arranged downstream of the printing group (18), wherein the printed web-shaped material (100) is folded and cut to form said products. The printing group (18) is provided with at least one melting or fluidifying group for feeding and heating the coloured waxes and paraffins (W), which need to be fluidified to be able to be applied onto the web-shaped material (100), and with one or more heating means (38; 58, 60, 62) capable of avoiding the cooling, and therefore the solidification, of the coloured waxes and paraffins (W) fed by the melting group before the waxes (W) themselves have been applied onto the web-shaped material (100).

17 Claims, 6 Drawing Sheets

(56) References Cited

U.S. PATENT DOCUMENTS

| | | | | | |
|---|---|---|---|---|---|
| 3,229,627 | A | | 1/1966 | Pollitt | |
| 3,412,707 | A | | 11/1968 | West et al. | |
| 4,094,241 | A | * | 6/1978 | Kossler | 101/120 |
| 4,671,205 | A | * | 6/1987 | Billeter | 118/68 |
| 4,693,179 | A | * | 9/1987 | Watts | 101/119 |
| 4,920,881 | A | * | 5/1990 | Tafel | 101/488 |
| 5,243,904 | A | * | 9/1993 | Hayama et al. | 101/120 |
| 5,254,399 | A | * | 10/1993 | Oku et al. | 442/351 |
| 5,285,976 | A | * | 2/1994 | Schmid et al. | 242/557 |
| 5,301,609 | A | * | 4/1994 | Guaraldi et al. | 101/216 |
| 5,385,093 | A | * | 1/1995 | Rogge et al. | 101/247 |
| 5,450,793 | A | * | 9/1995 | Dobson et al. | 101/487 |
| 5,772,763 | A | * | 6/1998 | Himes et al. | 118/213 |
| 5,807,517 | A | * | 9/1998 | Wissmann et al. | 264/211.23 |
| 5,935,880 | A | * | 8/1999 | Wang et al. | 442/65 |
| 6,213,014 | B1 | * | 4/2001 | Motoe et al. | 101/116 |
| 6,283,022 | B1 | * | 9/2001 | Kamen et al. | 101/129 |
| 6,382,093 | B1 | * | 5/2002 | Hara | 101/116 |
| 6,458,211 | B1 | * | 10/2002 | Wefers et al. | 118/669 |
| 6,598,527 | B1 | * | 7/2003 | Harper-Smith et al. | 101/484 |
| 7,044,580 | B2 | * | 5/2006 | Kimura | 347/33 |
| 2001/0032555 | A1 | * | 10/2001 | Isozaki et al. | 101/119 |
| 2006/0130685 | A1 | * | 6/2006 | Luginbuhl | 101/348 |
| 2006/0231295 | A1 | * | 10/2006 | Yamaguchi et al. | 177/25.18 |
| 2007/0006764 | A1 | * | 1/2007 | Brost et al. | 101/485 |
| 2007/0212960 | A1 | * | 9/2007 | Walton et al. | 442/59 |
| 2008/0075932 | A1 | * | 3/2008 | Bartesaghi | 428/195.1 |

FOREIGN PATENT DOCUMENTS

| | | | | |
|---|---|---|---|---|
| NL | 1 030 670 | C2 | 6/2007 | |
| WO | WO99/41081 | A | 8/1999 | |
| WO | WO2006/066972 | * | 6/2006 | B41M 1/00 |

* cited by examiner

MACHINE FOR THE IN-LINE TRANSFORMATION OF SINGLE-USE PRODUCTS, HEAT-PRINTED WITH COLOURED WAXES AND PARAFFINS

The present invention refers to a machine for the in-line transformation of single-use products and, more specifically, to a machine for heat-printing with coloured waxes and paraffins, and for producing moistened and non-moistened wipes or tissues.

Disposable hygienic tissues, soaked with deodorising, disinfectant and/or detergent liquids, are widely used, thanks to their high practicality, both for cleaning the face and hands and for cleaning private areas, above all in new-born babies, as well as in many other applications.

The use for which such tissues are intended, in other words for contact with the skin and the private areas of the human body, necessitates very high hygiene standards and the absence of any type of contamination during the production process. These requirements must be satisfied even, and above all, in the case in which it is wished to print decorative patterns, trademarks or inscriptions of whatever type on the tissues.

In the current state of the art, to decorate and/or print hygienic wipes or tissues that will then optionally be soaked with perfumed or detergent solutions, it is not possible to use all well-known inks, since such inks could, during the subsequent wetting process of the tissues, release coloured halos such as to pollute the tissues themselves from the health and hygiene point of view.

The purpose of the present invention is therefore to make a machine for the in-line transformation of single-use products, in particular a machine for heat-printing and for producing moistened and non-moistened wipes or tissues, capable of applying decorative patterns, trademarks or inscriptions onto the products themselves without causing their contamination, therefore safeguarding their hygienic and toxicological aspects.

Another purpose of the invention is to make a machine for the in-line transformation of single-use products capable of producing moistened and non-moistened wipes or tissues, from any web-shaped printing support such as fabric, unwoven fabric or paper, which are perfectly non-toxic and thus suitable for use on the skin of the human body.

A further purpose of the invention is to make a machine for the in-line transformation of single-use products capable of obtaining the finished produced, printed, optionally moistened, ready for packaging and thus ready for use, without the need to arrange the intermediate machining steps on other machinery.

Yet another purpose of the invention, lastly, is to make a machine for the in-line transformation of single-use products capable of manufacturing moistened and non-moistened wipes or tissues in a simple and cost-effective manner.

These purposes according to the present invention are accomplished by making a machine for the in-line transformation of single-use products, in particular a machine for heat-printing and for producing moistened and non-moistened wipes or tissues, as outlined in claim 1.

Further characteristics of the invention are highlighted in the subsequent claims, which are an integral part of the present description.

The characteristics and the advantages of a machine for the in-line transformation of single-use products according to the present invention shall become clearer from the following description, given as an example and not for limiting purposes, referring to the attached schematic drawings in which.

Figure 1:
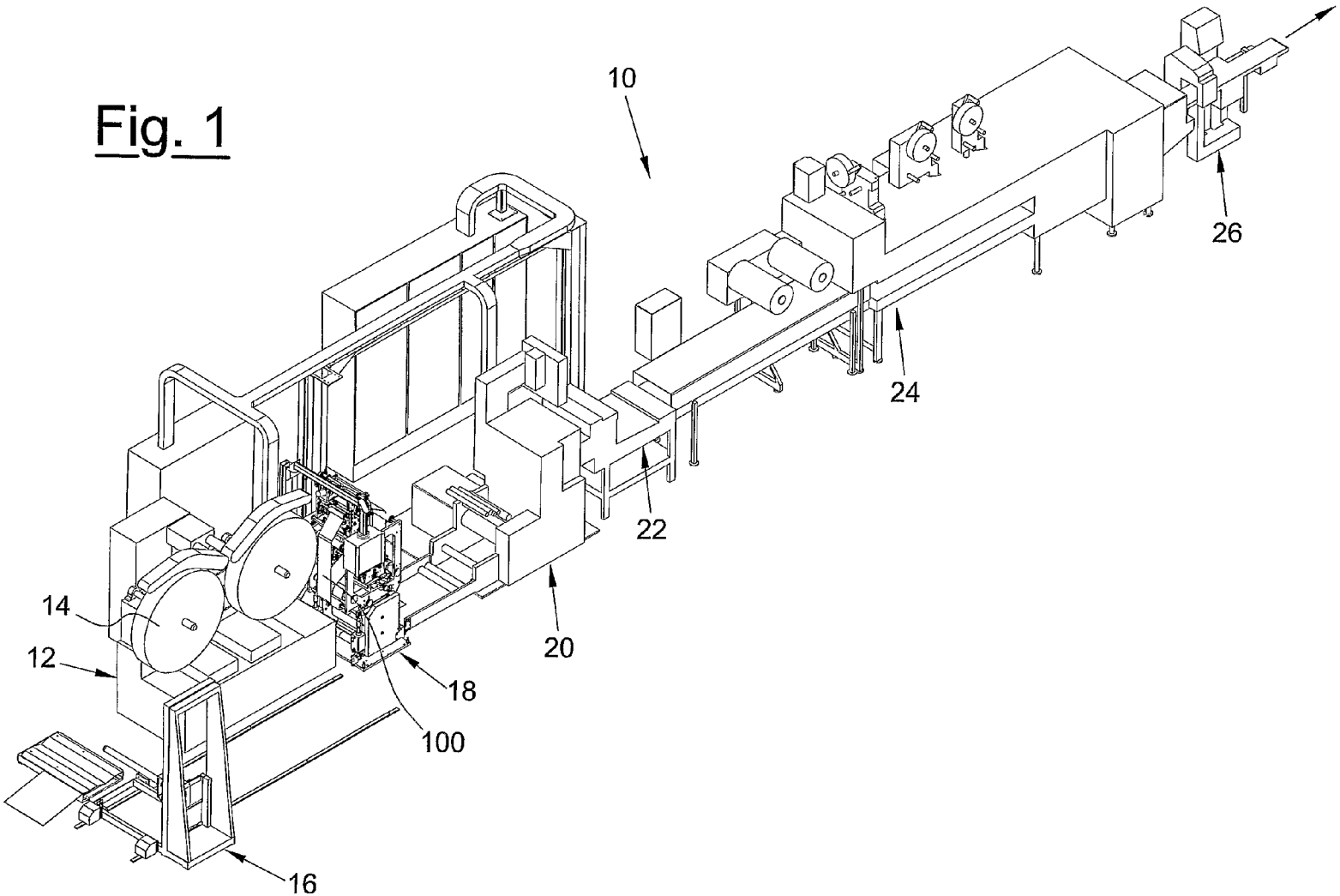
FIG. 1 is a schematic perspective view of a machine for the in-line transformation of single-use products according to the present invention.

With reference in particular to FIG. 1, a machine for the in-line transformation of single-use products according to the present invention is shown, wholly indicated with reference numeral 10.

The machine 10 is provided with a plurality of distinct modules arranged in line, in other words arranged in sequence one after the other, which make it possible to make, fold and possibly package, for example, printed and/or decorated wipes or tissues, subsequently soaked with deodorising, disinfectant and/or detergent substances or liquids, from a generic web-shaped printing support 100.

In detail, the machine 10 firstly comprises a first unwinding module or group 12 for one or more reels 14 of web-shaped material 100, such a web-shaped material 100 constituting the base support for the single-use products (tissues) to be made. Therefore, it is possible to foresee, at such an unwinding group 12, a lifting module 16 capable of moving the reels 14 to introduce them onto the unwinding group 12 itself.

Figure 8:
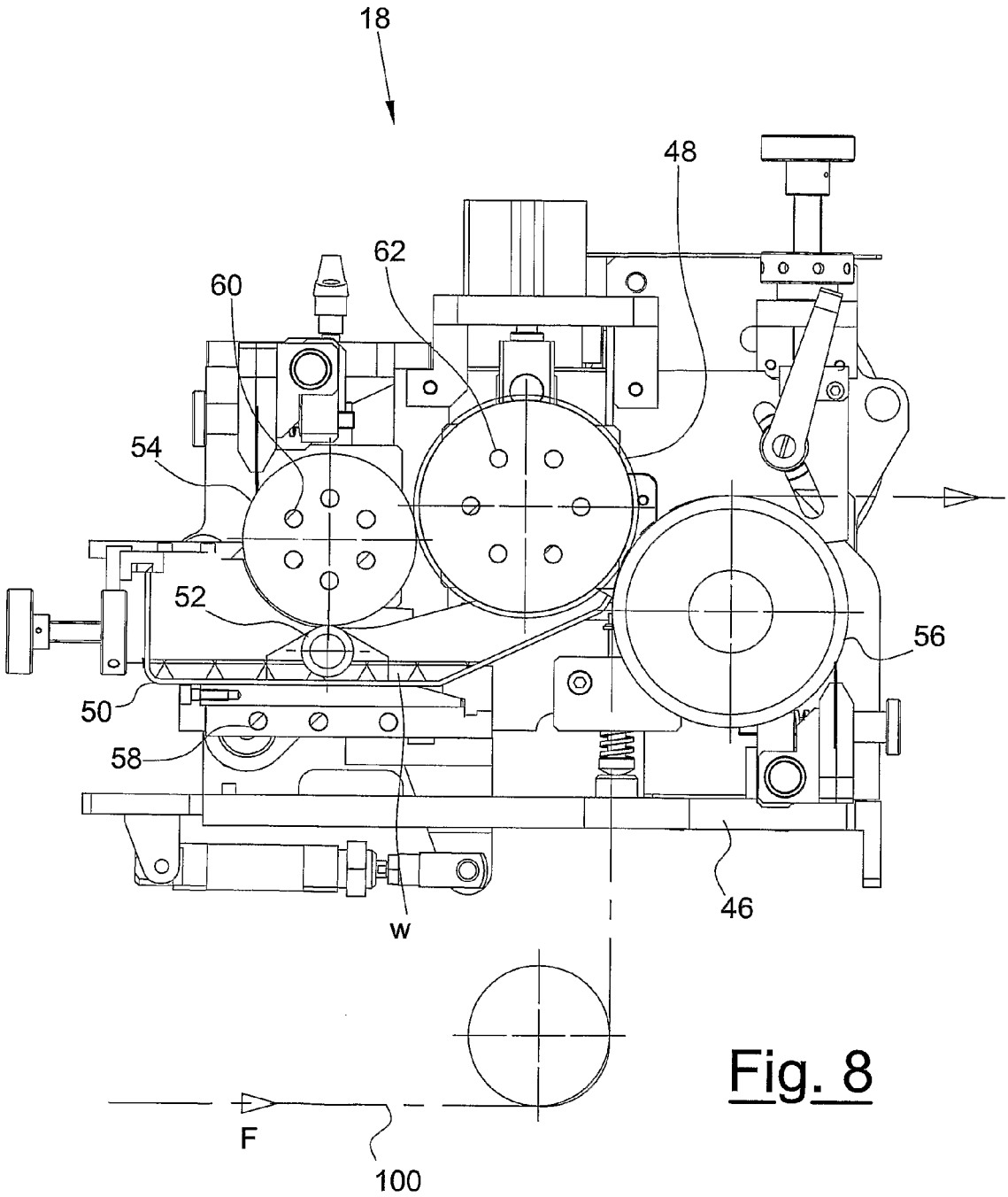
FIG. 8 is a side elevation view of the printing station shown in FIG. 7.

The web 100 coming from the unwinding of each reel 14 is introduced, downstream of the unwinding group 12, into a printing module 18 capable of heat-printing decorative patterns, trademarks and/or inscriptions on it, and thus on each tissue deriving from it, with a particular paraffin or natural wax based ink W (FIGS. 4 and 8) and/or mixtures thereof, as shall be specified in greater detail hereafter.

Once the indelible print of the desired pattern has been obtained on the web 100, it is fed to a folding and cutting and optionally soaking module or station 20, arranged downstream of the printing module 18. Inside the folding and cutting station 20 the printed web 100 can be soaked with solutions of different types, such as deodorants, disinfectants and/or detergents. During the soaking step, the printed web 100 can be made to pass over a special roller equipped with orifices from which the foreseen soaking solution comes out, or else the web 100 itself can be subjected to jets of the deodorant and/or detergent substance, dispensed by suitable nebulising nozzles, or furthermore it can be dipped in a container containing the deodorant and/or detergent substance to be applied onto it.

Once soaked, the web 100 is folded in the desired manner inside the station 20, for example provided with a folding group of the type with counter-rotating rollers, and it is then cut to form tissues or wipes of predetermined dimensions. The tissues thus formed can then be sent, through an automatic transfer station 22, to a subsequent packaging station 24.

In addition, it is possible to foresee an additional wetting step of the tissues, to be carried out after the folding and cutting operations, through a soaking device (not shown) distinct and separate from the folding and cutting station 20 and arranged downstream of it.

Inside the packaging station 24, in a per se known way, it is possible to foresee piles consisting of a predetermined number of printed, soaked and folded tissues, such piles thus being ready to be packaged, by the packaging station 24 itself, in suitable sealed packs ready for use.

Downstream of the packaging station 24 it is lastly possible to foresee a control station 26 capable of carrying out weighing, counting, checking or controls of another type on the packs coming out from the packaging station 24 itself.

Figure 2:
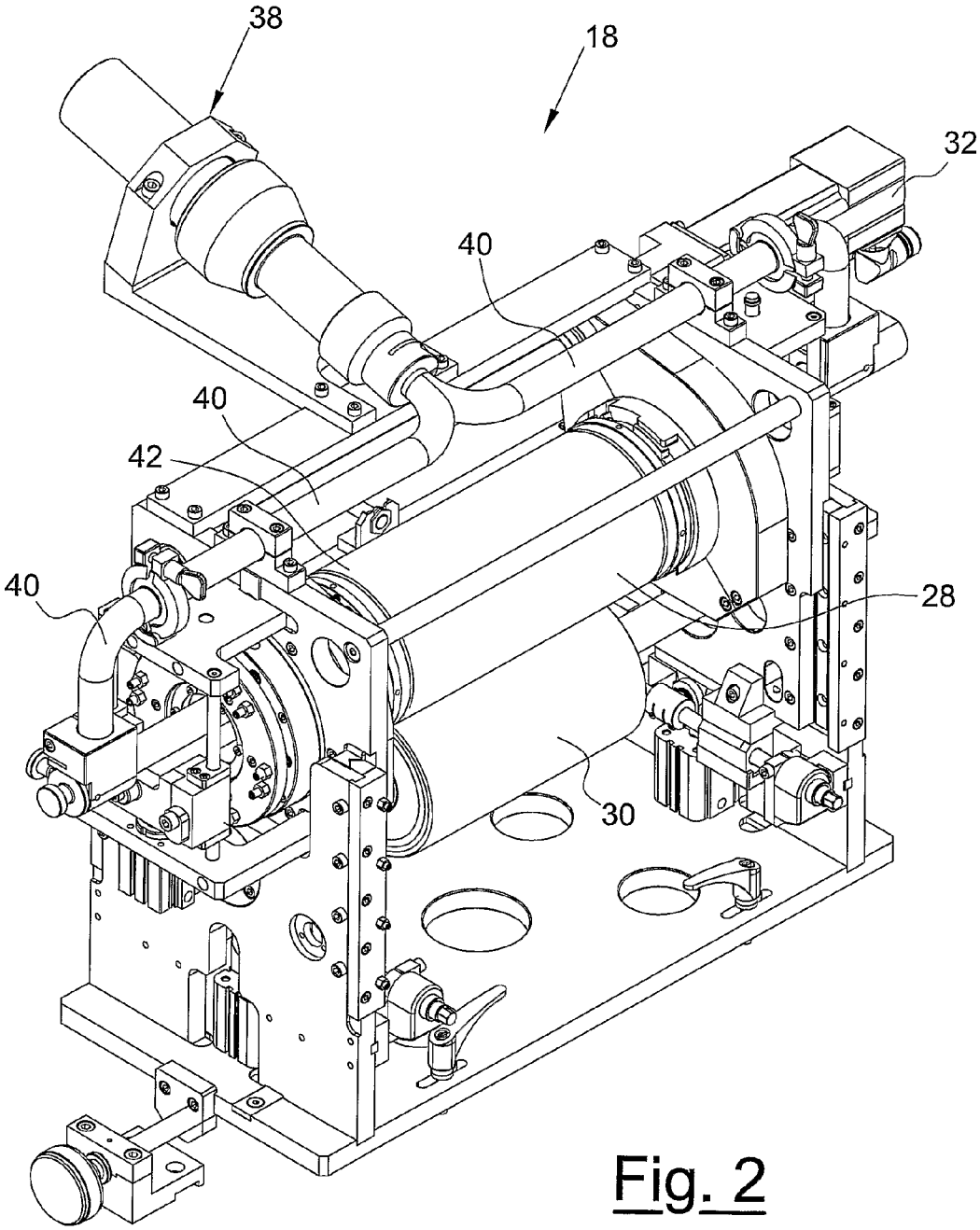
FIG. 2 is a perspective view of a first embodiment of a printing station that can be applied to the machine for the in-line transformation of single-use products of FIG. 1.

FIG. 2 shows a perspective view of a first embodiment of a printing module 18 belonging to the machine 10. In particular, the printing module 18 of FIG. 2 is configured to operate according to the well-known silk-screen printing technique.

According to such an embodiment, the printing module 18 is able to actuate a hot silk-screen printing process to decorate at least one portion of each tissue, coming from the web 100, with a molten substance W insoluble in water. Such an insoluble substance W is selected from paraffins, natural waxes and/or mixtures thereof, and it is also mixed with dyes and/or pigments.

Figure 6:
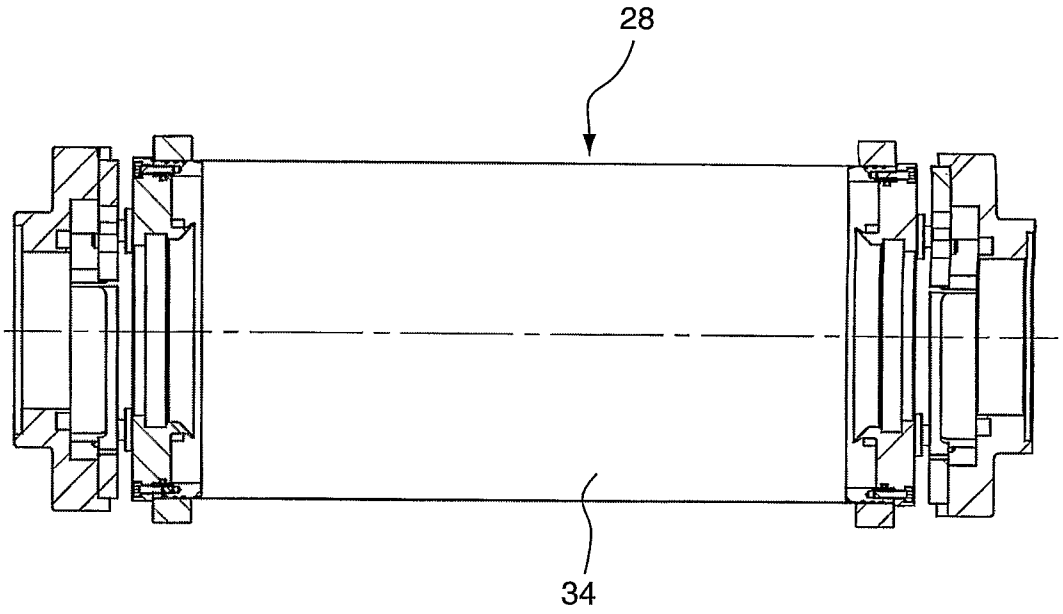
FIG. 6 is a section view, obtained along the line A-A of FIG. 5, of a printing cylinder belonging to the printing station shown in FIG. 2.
Figure 5:
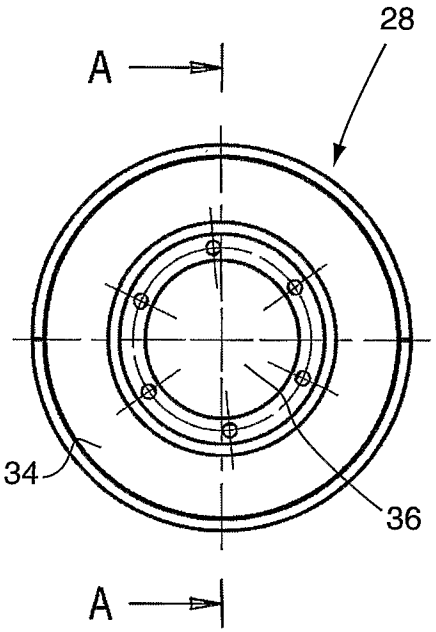
FIG. 5 is a side elevation view of a printing cylinder belonging to the printing station shown in FIG. 2.

The hot silk-screen printing process takes place by making the web 100 unwound from the reel 14 travel inside the printing module 18. Such a printing module substantially comprises a printing cylinder 28, rotating around its own axis of symmetry and in operative contact with a contrast cylinder 30. The printing cylinder 28 is actuated by a suitable driving motor 32, in electrical alignment with the folding and cutting station 20 so as to always obtain a printing process in phase with the subsequent folding operation, both in the acceleration step of the machine 10 and at the set normal operating speed. The structure of the printing cylinder 28 consists of a hollow nickel cylinder, with a preferred low thickness equal to 0.08 mm, suitably connected to the frame of the printing module 18 by means of an outer sleeve 34. The assembly thus made is known as printing sleeve and/or cylinder, and defined an internal cavity 36 with substantially axial extension (FIGS. 5 and 6).

The printing module 18 is provided with a melting or fluidifying group (not shown) for heating the wax W, preferably paraffin, which needs to be fluidified to be able to be printed onto the web-shaped support 100, and for feeding such a fluid wax W into the internal cavity 36 of the printing cylinder 28. Advantageously, during the operation of the machine 10, the melting group is able to keep the wax W to be fed to the printing cylinder 28 of the printing module 18 at a temperature of about 85-90° C., so as to ensure that it stays in fluid state.

In addition, the printing module 18 is provided with at least one heating group 38, for example using hot air, capable of avoiding excessive cooling, and thus solidification, of the wax W fed by the melting group before it has been printed onto the web-shaped support 100. The heating group 38 comprises a plurality of ducts 40 capable of blowing hot air inside the printing cylinder 28 and, more specifically, into the internal cavity 36 defined in the printing sleeve 34. The temperature of the air blown is controlled by means of a sensor, typically and infra-red sensor, and a relative temperature detection instrument. In this way, the temperature of the wax W is kept at a sufficiently high level to allow it to stay in fluid state during the printing step on the web-shaped support 100 that will go to form the tissues.

The printing sleeve 34 is made with a suitable silk-screen printing mesh and it is provided with surface micro through-holes 42 for releasing the wax W onto the printing support 100. The diameter and, consequently, the extension of printing defined by the cylinder 28 is standardised according to the folding format foreseen in the subsequent folding and cutting module 20.

Figure 4:
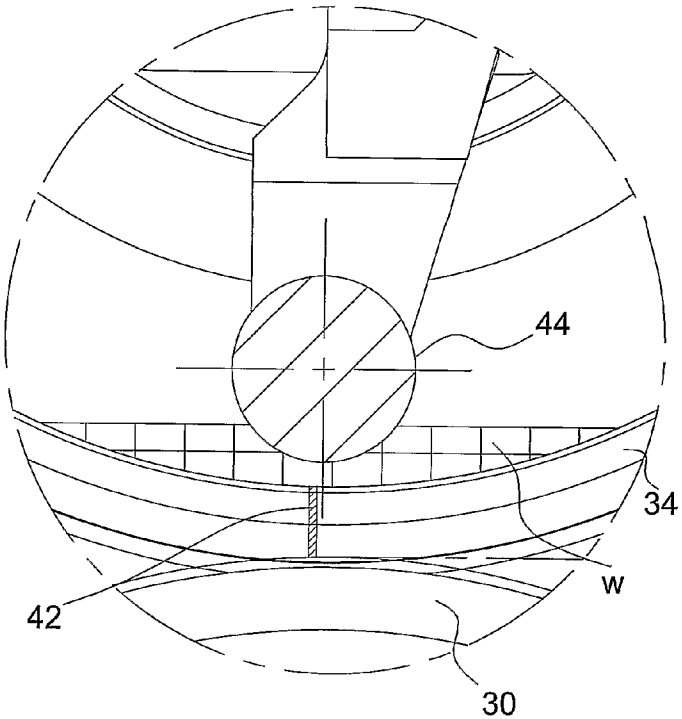
FIG. 4 is a detailed partial section view of a detail of the printing station shown in FIG. 2.
Figure 3:
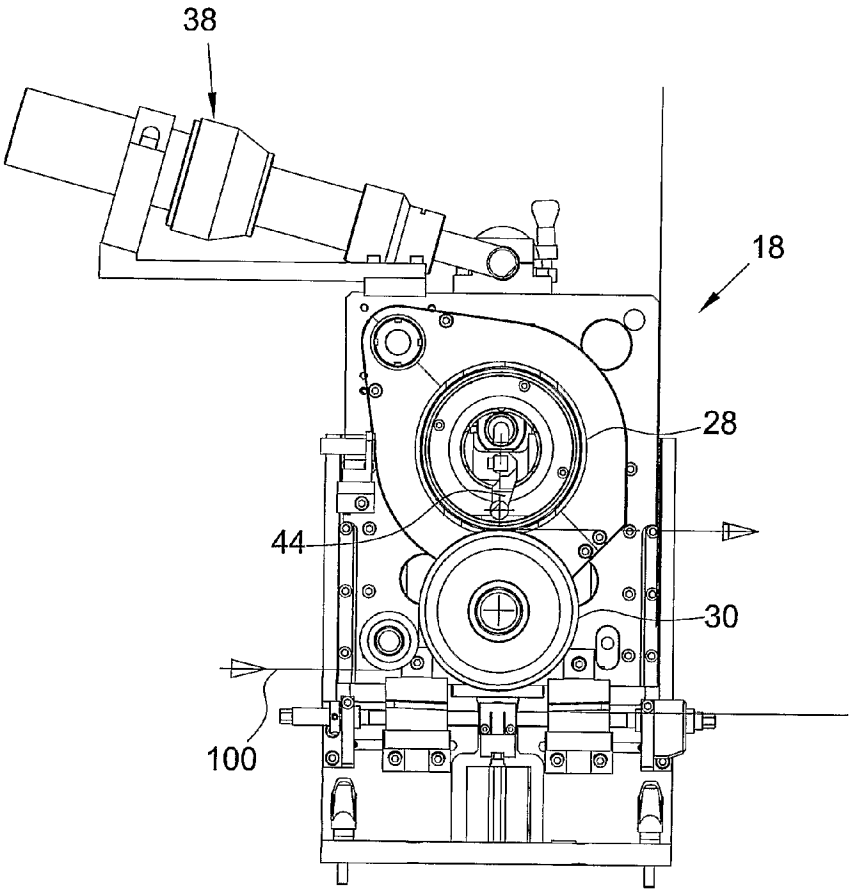
FIG. 3 is a side elevation view of the printing station shown in FIG. 2.

As shown in the detailed view of FIG. 4, inside the printing cylinder 28 a doctor blade 44, of the type with a spinning roller on the inner surface of the printing sleeve 34, is foreseen, which has the task of spreading and pressing down the hot and fluid wax W, contained inside the cavity 36 and coming from the melting group, on the web-shaped support 100 passing through the printing module 18. This allows perfect spreading of the coloured waxes or paraffins through the micro holes 42 made on the printing sleeve 34 of the cylinder 28 that, based upon their specific arrangement, form the figure or the decoration to be printed on the support 100.

The contrast cylinder 30 is made from chromed and rectified aluminium alloy and may or may not be provided with cooling systems, for example with refrigerated water. Such a cooling operation does, indeed, allow the adhesion between the support 100 and the wax W to be improved. Alternatively, the cooling or drying step could simply consist of exposing the web-shaped support 100 to contact with the air, downstream of the printing step, for a certain period of time before the subsequent wetting operation. The printing pressure defined by the contrast cylinder 30 can be regulated by means of a wedge system, which allows micrometric regulation of the pressure.

Figure 7:
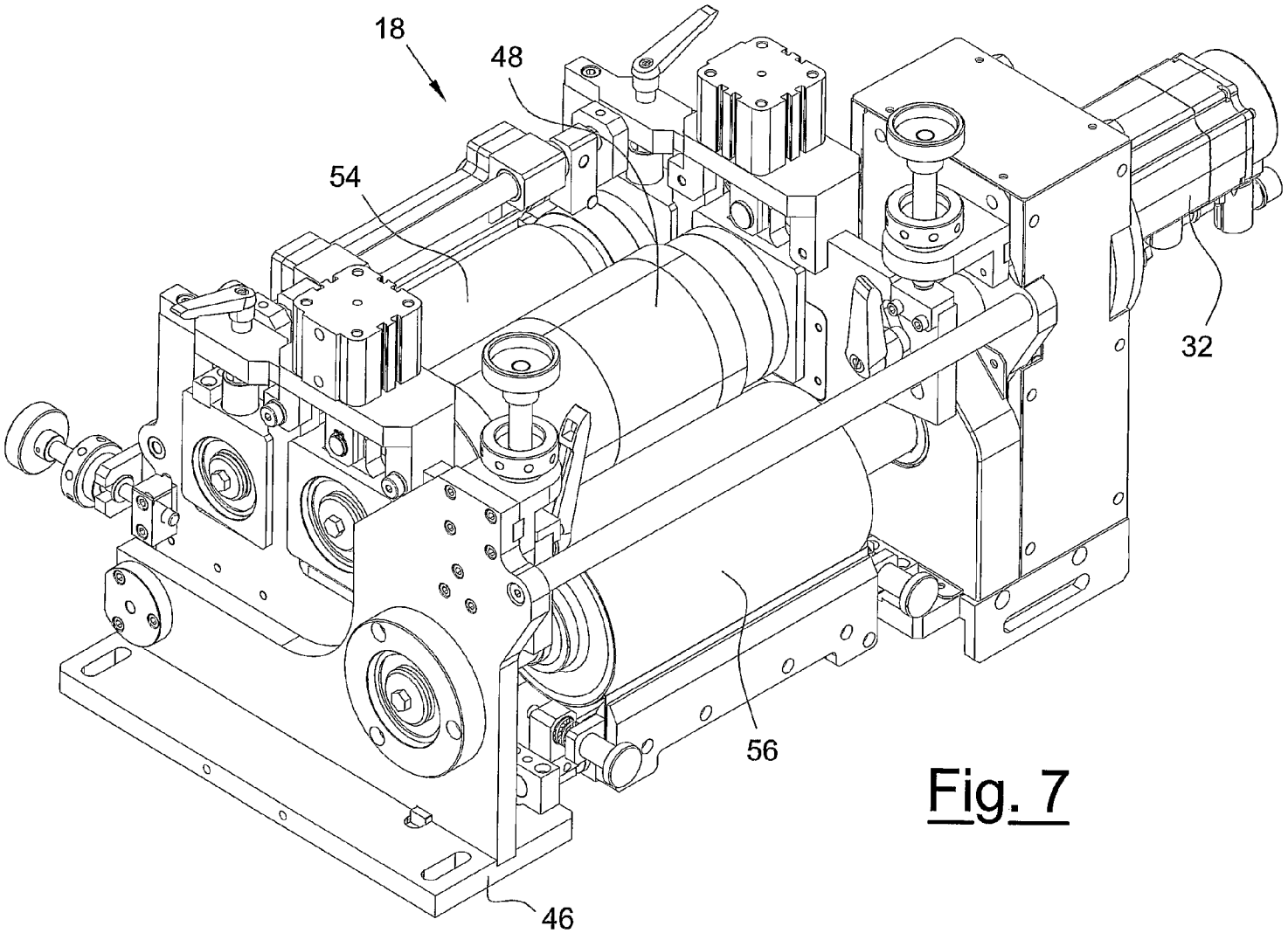
FIG. 7 is a perspective view of a second embodiment of a printing station that can be applied to the machine for the in-line transformation of single-use products of FIG. 1.

FIG. 7 shows a perspective view of a second embodiment of a printing module 18 belonging to the machine 10. In particular, the printing module 18 of FIG. 7 is configured to operate according to the well-known flexographic printing technique.

Also based upon this second embodiment, the printing module 18 is able to actuate a hot flexographic printing process to decorate at least a portion of each tissue with a molten substance W insoluble in water. Such an insoluble substance W is once again selected from paraffins, natural waxes and/or mixtures thereof, and it is also mixed with dyes and/or pigments.

The flexographic printing module 18 substantially comprises a frame 46 on which a printing plate cylinder (48) is mounted, suitable for applying the fluid wax W, picked up from a suitable tray 50 (FIG. 8) by means of a rubber-coated roller 52 and a dimpled inking cylinder 54 of the so-called "anilox" type in contact with the printing plate cylinder 48 and rotating in the opposite direction to it, on the continuous web 100. The web 100 is fed in the direction of the arrow F and is kept in contact with the printing plate cylinder 48 by means of a contrast cylinder 56 that rotates in the opposite direction to said printing plate cylinder 48. Also in this example embodiment of the printing module 18 it is foreseen to have a driving motor 32 to move the various cylinders and a melting or fluidifying group for heating the coloured waxes and paraffins W that constitute the printing ink.

In order to keep the wax in fluid state before application onto the web 100, the tray 50 is provided with heating means consisting, for example, of one or more electrical resistances 58 kept at a controlled temperature. The electrical resistances 58 can, for example, be of the cartridge type, each with an electrical power of 300 W.

Similarly, the printing cylinders, in other words the printing plate cylinder 48 and the inking cylinder 54, and possibly the rubber-coated roller 52, can also be heated by means of respective electrical resistances 60 and 62 inserted inside of them, connected with rotary collectors and with a device for controlling the temperature of the different areas of each cylinder. Also in this case the resistances can, for example, be of the cartridge type, capable of maintaining a constant temperature of 85-87° C. on the surface of the cylinders.

Alternatively, other heating means can also be used, operating electrically or with hot fluid.

The temperature detection and control are carried out by suitable sensors and/or probes, typically using infra-red.

The rubber-coated roller 52 is coated in material, like silicon rubber, resistant to high temperatures, and it is provided with a pneumatic device, managed by the central control system (PLC) of the machine 10, to move away from the dimpled cylinder 54. A sliding block system is foreseen to hold the excess wax W.

The dimpled cylinder 54 is equipped with an interchangeable jacket and with different flow rate of ink, to suit the desired printing characteristics and so as to optimise the transportation of the wax W towards the printing plate cylinder 48. The dimpled cylinder 54 is provided with a device for manually adjusting the pressure on the printing plate cylinder 48 and with a sliding block system to hold the excess wax W at the side.

The printing plate cylinder 48 is provided with an aluminium interchangeable jacket, with quick-fastening means of the bayonet type, as well as with a pneumatic device for moving out of the printing position, with micrometric regulation of the printing pressure on the support 100.

Finally, the contrast cylinder 56 can be provided with a cooling system with refrigerated water in order to improve the adhesion between the support 100 and the wax W.

Irrespective of their embodiment type, the printing stations 18 of the machine 10 are able to print upon a web-shaped support 100 that can consist of fabric, non-woven fabric or paper. It is also possible to print with wax on embossed fabrics, although with lower definition. The decorative patterns, trademarks and/or logos can be printed either on a single side of the support 100, and thus of the tissues that they will become, or on both sides.

In the case in which it is wished to print images with a plurality of colours, a corresponding number of printing stations 18 can be used operating in sequence on the web 100.

It has thus been seen that the machine for the in-line transformation of single-use products according to the present invention achieves the aforementioned purposes. Unlike the machines that use standard silk-screen and flexographic printing devices found on the market, which use conventional inks with or without added solvents, such a machine allows the following advantages to be obtained:

- safeguarding the hygienic and toxicological features of the processed product (wet and non-wet tissue), after the use of natural waxes and paraffins coloured with non-toxic pigments in compliance with FDA (Food and Drug Administration) standards and with cosmetic use;
- possibility of moistening the printed product with disinfectant, deodorant and/or detergent liquids or solutions, avoiding the drawback linked to the formation of coloured halos that can pollute the product itself from the point of view of health and hygiene;
- use of energy and substances (inks, hot air) in an environmentally-sustainable and friendly way and compliant with current safety standards;
- possibility of carrying out further treatments of the printed web immediately after the printing step, since the stabilisation of the print is substantially instantaneous, unlike the conventional printing process that requires substantial drying times and often requiring specific additional apparatuses (UV rays and similar);
- possibility of a close coupling of the printing station with the folding and cutting station, in this way ensuring a well aligned printing (without misalignments) of the cut product.

The machine for the in-line transformation of single-use products of the present invention thus conceived can in any case undergo numerous modifications and variants, all of which are covered by the same inventive concept; moreover, all the details can be replaced by technically equivalent elements, whereas the shapes and sizes can be whatever according to the technical requirements.

The scope of protection of the invention is therefore defined by the attached claims.

The invention claimed is:

1. Machine (10) for the in-line transformation of wipes or tissues, comprising at least one unwinding group (12) for one or more reels (14) of web-shaped material (100), which constitutes the base support for said wipes or tissues, at least one printing group (18), arranged immediately downstream of said unwinding group (12), said printing group (18) being capable of heat-printing decorative patterns, trademarks and/or inscriptions with a paraffin or natural wax-based ink (W) and/or mixtures thereof on said web-shaped material (100) and at least one folding and cutting group (20), arranged downstream of said printing group (18), wherein said printed web-shaped material (100) is folded and cut to form said wipes or tissues, said printing group (18) being provided with at least one melting or fluidifying group for feeding and heating said ink (W), which needs to be fluidified to be able to be printed onto said web-shaped material (100), and with one or more heating means (38; 58, 60, 62) capable of avoiding the cooling, and therefore the solidification, of said ink (W) fed by said melting group before said ink (W) has been printed onto said web-shaped material (100) wherein said printing group (18) is able to operate according to the silk-screen printing technique and comprises at least one printing cylinder (28) connected to the frame of said printing group (18) by means of an outer sleeve (34) that defines an inner cavity (36) with substantially axial extension, wherein said inner cavity has a first end and a second end, wherein said melting or fluidifying group is able to feed the ink (W) into said inner cavity (36) of the printing cylinder (28), wherein said heating means (38) comprise a plurality of ducts (40) able to blow hot air inside said inner cavity (36) of the printing cylinder (28) said ducts being positioned so that a first duct blows hot air into said first end of said inner cavity (36) and a second duct blows hot air into said second end of said inner cavity (36), and wherein said printing group (18) comprises sensor means for controlling the temperature of the air blown inside said inner cavity (36) of the printing cylinder 28.

2. Machine (10) according to claim 1, characterised in that said outer sleeve (34) is provided with surface micro through-holes (42), suitable for releasing the ink (W) onto said web-shaped material (100).

3. Machine (10) according to claim 1, characterised in that inside said inner cavity (36) of the printing cylinder (28) is housed at least one doctor blade (44) that has the task of spreading and pressing down the ink (W) on said web-shaped material (100).

4. Machine (10) according to claim 1 characterised in that said doctor blade (44) is of the type with a spinning roller on the inner surface of said sleeve (34).

5. Machine (10) according to claim 1, characterised in that said printing cylinder (28) is placed in operative contact with a contrast cylinder (30) provided with a cooling system with refrigerated water.

6. Machine (10) according to claim 5, characterised in that the printing pressure defined by said contrast cylinder (30) is regulated by means of a wedge system.

7. Machine (10) for the in-line transformation of single-use wipes or tissues, comprising at least one unwinding group (12) for one or more reels (14) of web-shaped material (100), which constitutes the base support for said wipes or tissues, at least one printing group (18), arranged immediately downstream of said unwinding group (12), capable of heat-printing decorative patterns, trademarks and/or inscriptions with a paraffin or natural wax-based ink (W) and/or mixtures thereof on said web-shaped material (100), and at least one folding and cutting group (20), arranged downstream of said printing group (18), wherein said printed web-shaped material (100) is folded and cut to form said wipes or tissues, said printing group (18) being provided with at least one melting or fluidifying group for feeding and heating said ink (W), which needs to be fluidified to be able to be printed onto said web-shaped material (100), and with one or more heating means (38; 58, 60, 62) capable of avoiding the cooling, and therefore the solidification, of said ink (W) fed by said melting or fluidifying group before said ink (W) has been printed onto said web-shaped material (100), wherein said printing group (18) is able to operate according to the flexographic printing technique and comprises at least one printing plate cylinder (48) suitable for applying the ink (W), picked up from a tray (50) by means of a rubber-coated roller (52) and an inking cylinder (54) in contact with said printing plate cylinder (48) and rotating in the opposite direction to it, on said web-shaped material (100), wherein said heating means (58, 60, 62) comprise one or more electrical resistances kept at a controlled temperature of about 85-90° C., said one or more electrical resistances being arranged at said tray (50), in order to keep the ink (W) in fluid state, and respectively inserted inside said printing plate cylinder (48) and said inking cylinder (54), and wherein said electrical resistances (58, 60, 62) are connected with rotary collectors and with sensor means for controlling the temperature to about 85-90° C.

8. Machine (10) according to claim 7, characterised in that said inking cylinder (54) is equipped with an interchangeable jacket and with different flow rates of ink (W), so as to optimise the transportation of the ink (W) towards said printing plate cylinder (48).

9. Machine (10) according to claim 8, characterised in that said inking cylinder (54) is provided with a manual device for adjusting the pressure on said printing plate cylinder (48) and with a sliding block system for holding the excess ink (W).

10. Machine (10) according to claim 7, characterised in that said printing plate cylinder (48) is placed in operative contact with a contrast cylinder (56) provided with a cooling system with refrigerated water.

11. Machine (10) according to claim 7, characterised in that said folding and cutting group (20) is also able to soak said web-shaped material (100) with deodorising, disinfectant and/or detergent solutions.

12. Machine (10) according to claim 7, also comprising at least one soaking device, distinct and separate from said folding and cutting group (20) and arranged downstream of it, capable of carrying out an additional wetting step of said wipes or tissues.

13. Machine (10) according to claim 7, also comprising:

at least one packaging group (24), arranged downstream of said folding and cutting group (20), in which said wipes or tissues are stacked and packaged in sealed packs;

at least one control group (26), arranged downstream of said packaging group (24), capable of carrying out weighing, counting, checking or other types of controls on the packs coming out from said packaging group (24); and at least one lifting group (16), arranged at said unwinding group (12), capable of moving said reels (14) to introduce them onto said unwinding group (12).

14. Machine (10) according to claim 1, characterised in that said folding and cutting group (20) is also able to soak said web-shaped material (100) with deodorising, disinfectant and/or detergent solutions.

15. Machine (10) according to claim 14, also comprising at least one soaking device, distinct and separate from said folding and cutting group (20) and arranged downstream of it, capable of carrying out an additional wetting step of said wipes or tissues.

16. Machine (10) according to claim 1, also comprising:

at least one packaging group (24), arranged downstream of said folding and cutting group (20), in which said wipes or tissues are stacked and packaged in suitable sealed packs;

at least one control group (26), arranged downstream of said packaging group (24), capable of carrying out weighing, counting, checking or other types of controls on the packs coming out from said packaging group (24); and at least one lifting group (16), arranged at said unwinding group (12), capable of moving said reels (14) to introduce them onto said unwinding group (12).

17. Machine (10) for the in-line transformation of wipes or tissues, comprising at least one unwinding group (12) for one or more reels (14) of web-shaped material (100), which constitutes the base support for said wipes or tissues, at least one printing group (18), arranged immediately downstream of said unwinding group (12), said printing group (18) being capable of heat-printing decorative patterns, trademarks and/or inscriptions with a paraffin or natural wax-based ink (W) and/or mixtures thereof on said web-shaped material (100), and at least one folding and cutting group (20), arranged downstream of said printing group (18), wherein said printed web-shaped material (100) is folded and cut to form said wipes or tissues, said printing group (18) being provided with at least one melting or fluidifying group for feeding and heating said ink (W), which needs to be fluidified to be able to be printed onto said web-shaped material (100), and with one or more healing means (38; 58, 60, 62) capable of avoiding the cooling, and therefore the solidification, of said ink (W) fed by said melting group before said ink (W) has been printed onto said web-shaped material (100) wherein said printing group (18) is able to operate according to the silk-screen printing technique and comprises at least one printing cylinder (48) connected to the frame of said printing group (18) by means of an outer sleeve (34) that defines an inner cavity (36) wherein said inner cavity has a first end and a second end with substantially axial extension, wherein said melting or fluidifying group is able to feed the ink (W) into said inner cavity (36) of the printing cylinder (28), wherein said heating means (38) comprise a plurality of ducts (40) able to blow hot air inside said inner cavity (36) of the printing cylinder (28) said ducts being positioned so that a first duct blows hot air into said first end of said inner cavity (36) and a second duct blows air into said second end of said inner cavity (36), and wherein said printing group (18) comprises sensor means for controlling the temperature of the air blown inside said inner cavity (36) of the printing cylinder 28 at 85-90° C. and said folding and cutting group (20) is also able to soak said web-shaped material (100) with deodorising, disinfectant and/or detergent solutions.

* * * * *